United States Patent [19]

Strawder

[11] Patent Number: 4,905,853

[45] Date of Patent: Mar. 6, 1990

[54] COMPARTMENTED RECEPTACLE

[76] Inventor: Glenn G. Strawder, 9200 Edwards Way #1116, Adelphi, Md. 20783

[21] Appl. No.: 307,912

[22] Filed: Feb. 9, 1989

[51] Int. Cl.[4] ..... B65D 1/24; B65D 21/02

[52] U.S. Cl. ..... 220/1 T; 220/22; 220/23.83; 220/404

[58] Field of Search ..... 220/1 T, 23.83, 20, 220/21, 22, 403, 404

[56] References Cited

U.S. PATENT DOCUMENTS

| | | | |
|---|---|---|---|
| 1,021,872 | 4/1912 | Kingsbury | 220/1 T |
| 3,648,875 | 3/1972 | Lundgren . | |
| 3,720,346 | 3/1973 | Cypher . | |
| 3,856,173 | 12/1974 | Deane et al. . | |
| 3,893,615 | 7/1975 | Johnson . | |
| 3,904,218 | 9/1975 | Kostle . | |
| 4,114,776 | 9/1978 | Pluss . | |
| 4,418,835 | 12/1983 | Watts | 220/404 |
| 4,729,489 | 3/1988 | Papaianni | 220/23.8 |
| 4,750,638 | 2/1988 | Sosower | 220/1 T |
| 4,750,639 | 6/1988 | Scheurer . | |
| 4,765,579 | 8/1988 | Robbins | 220/1 T |
| 4,834,253 | 5/1989 | Crine | 220/1 T |
| 4,834,262 | 5/1989 | Reed | 220/1 T |

FOREIGN PATENT DOCUMENTS

| | | | |
|---|---|---|---|
| 1496934 | 8/1967 | France | 220/353 |

*Primary Examiner*—Stephen Marcus

*Attorney, Agent, or Firm*—William D. Hall

[57] ABSTRACT

A trash can has a rim at its upper end. A divider, made up of a plurality of arms, cooperates with the rim to form a plurality of open spaces at the top of the can. The arms of the divider are supported by sockets mounted on the rim. Plastic trash bags hang below the open spaces. The bags are supported by projections or hooks on the divider and on the rim of the can. A cover or lid for the trash can has a generally vertical sidewall having a door above each trash bag.

19 Claims, 2 Drawing Sheets

COMPARTMENTED RECEPTACLE

BACKGROUND OF THE INVENTION

For both environmental and economic reasons it is desirable to sort trash collected in public places into the various types of products (glass, food, aluminum, for example) making up the trash. This has many advantages, at least one of which is that it facilitates recycling.

A number of attempts have been made in the past to provide a compartmented trash receptacle. Several examples follow. U.S. Pat. No. 3,648,875 issued to Lundgren in 1972 for a group of receptacles that are useful for sorting garbage. In 1973, U.S. Pat. No. 3,720,346 issued to Cypher for a trash receptacle having a central vertical rod and vanes extending from the rod at various angles to provide compartments for different types of trash. In 1974, U.S. Pat. No. 3,856,173 issued to Deane et al for an arrangement of cans on a rack for use in sorting trash. In 1975, U.S. Pat. No. 3,904,218 issued to Kostle for a group of cans on a platform said to be useful in sorting trash. In that patent, a common cover for the cans has a generally vertical sidewall with various doors for receiving various types of trash respectively. Other forms of compartmented trash receiving devices include U.S. Pat. Nos. 4,114,776 and 3,893,615 to Pluss and Johnson, respectively. In 1988, U.S. Pat. No. 4,750,639 issued for a can for pre-sorting garbage. That patent employed a roll of plastic packages and when a single package is removed from the roll it may be formed into a divider that divides the garbage can into three compartments.

SUMMARY OF THE INVENTION

My invention provides a new trash can, or an addition to an existing trash can, which is simple to make and use. Moreover, externally it is similar in size and overall appearance to trash cans that are in widespread use.

The invention employs a divider in the form of a plurality of horizontal arms. Each arm has a free end that is supported by a socket at the upper end of the trash can. Plastic trash bags are supported in the spaces between the horizontal arms. The bags are supported by projections or hooks on the divider as well as on the upper rim of the trash can.

A cover or lid for the trash can has an upwardly extending sidewall, with a separate door for each bag. Each door has a sign to designate the form of trash products to be fed through it.

The divider and the trash bags may be removed from the can as a unit. Similarly, the divider with new bags can be inserted in the trash can as a unit.

DETAILED DESCRIPTION OF THE INVENTION

Figure 1:
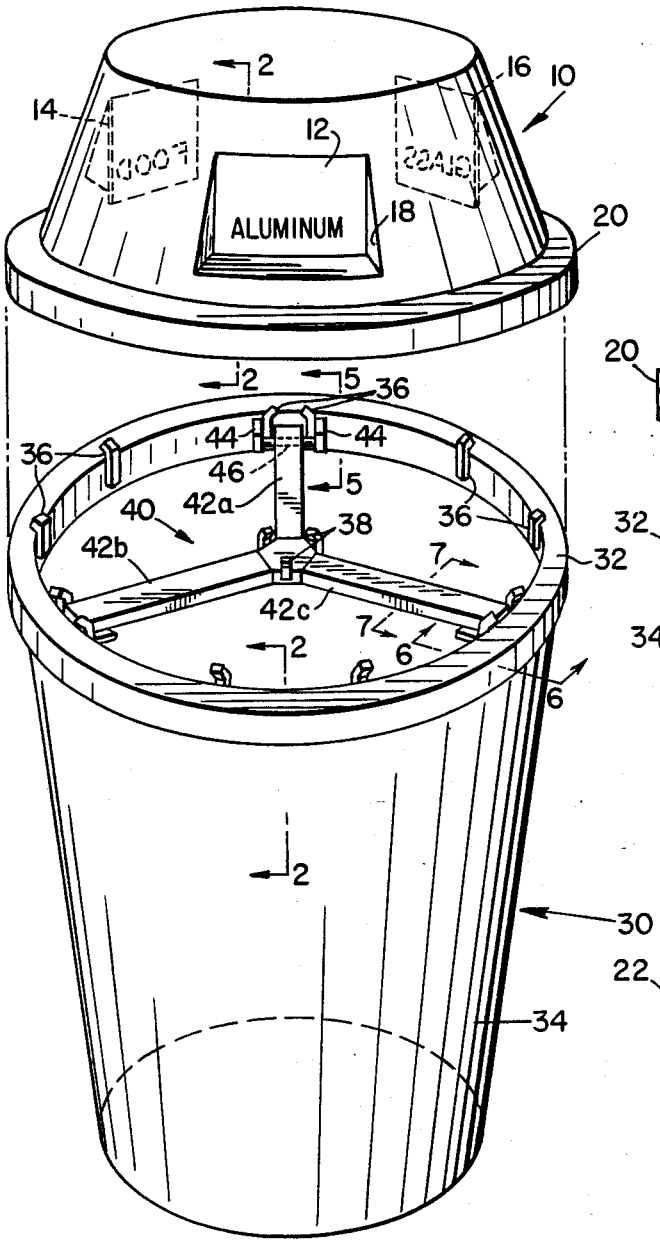
FIG. 1 is a perspective view of my new container.
Figure 5:
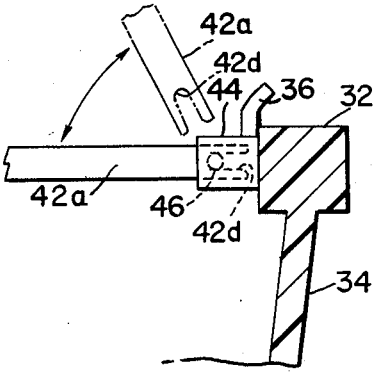
FIG. 5 is a detail view taken along line 5—5 of FIG. 1. It shows the details of the support for one end of the spoke 42*a* of the divider 40 of FIG. 1.

In the preferred form of the invention shown in FIG. 1 a container 30, for example a trash can such as would be located in a public park or anywhere else, has a bottom resting on the ground and a sidewall 34 terminating at its upper end in a rim 32. The rim 32 has two identical sockets shown in FIGS. 6 and 7; each of these two sockets having a horizontal shelf 48 and two projections 36 which act as sidewalls to hold arms 42*b* and 42*c* on their respective shelves. The third socket has two sidewalls 44 interconnected by a horizontal pin 46 as shown in FIG. 5.

A divider 40 comprises three arms 42*a*, 42*b* and 42*c*, interconnected at the center of the divider 40. Arm 42*a* has a forked free end 42*d* so that it can removably engage pin 46. When the forked end of arm 42*a* is around pin 46, the divider 40 may pivot around pin 46.

Figure 6:
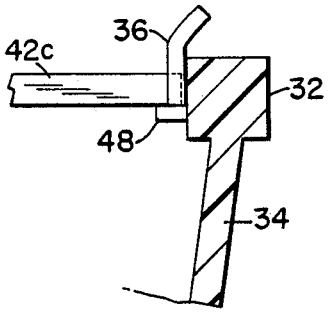
FIG. 6 is a detail view taken along line 6—6 of FIG. 1.
Figure 7:
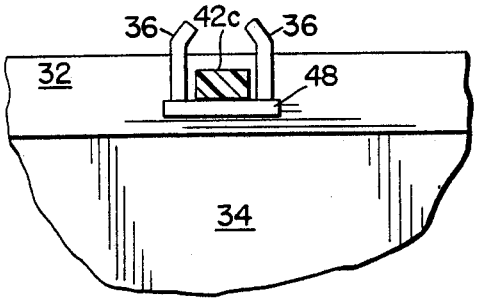
FIG. 7 is a detail view taken along line 7—7 of FIG. 1.

The free ends of arms 42*b* and 42*c*, each rest on a shelf 48 (FIGS. 6 and 7).

The sidewalls 36 or 44 of each socket prevent the arm from sliding out of the socket.

Figure 2:
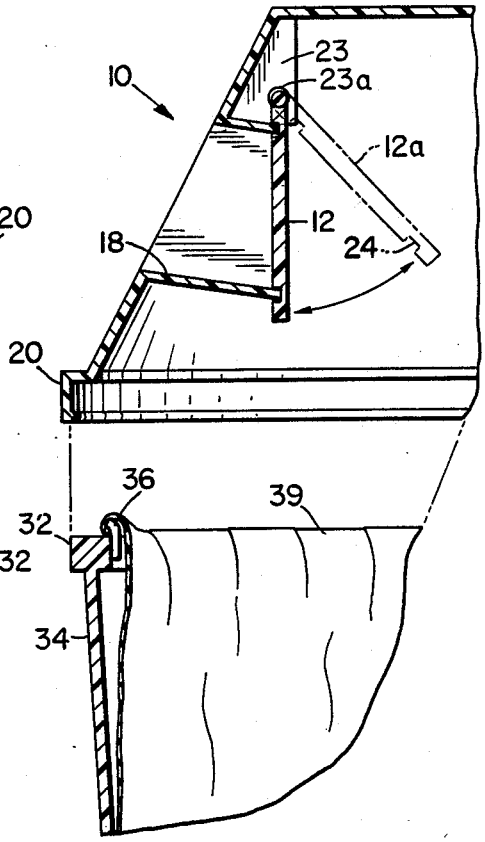
FIG. 2 is a sectional view taken along line 2—2 of FIG. 1.

Both the divider 40 and the rim 32 have a number of upward projections or hooks 36 and 38 for supporting plastic bags, such as bag 39 of FIG. 2. In the form of the invention shown in FIG. 1, three bags would be employed. If the bags have an inverted cuff 39 at their upper ends, the cuffs are placed over the projections or hooks 36 as shown in FIG. 2. One bag would fill the open space between arms 42*a* and 42*b*. Another bag would fill the open space between arms 42*b* and 42*c*, and the third bag would fill the space between arms 42*c* and 42*a*. If the bags do not have cuffs, the free ends of the bags would simply be placed above the projections or hooks 36 and pushed downwardly to thereby use each projection 36 to punch a hole in the upper sidewall of the bag.

A cover 10 has a lower rim 20 which makes a snug fit on rim 32. If desired a tongue 32*a* on one rim 32 and a groove 20*a* on the other rim 20 may insure that the cover 10 is always placed on the container 30 with a desired angular orientation. This will insure that, for example, glass placed in door 16 will always fall in the bag that is intended to receive glass.

Figure 3:
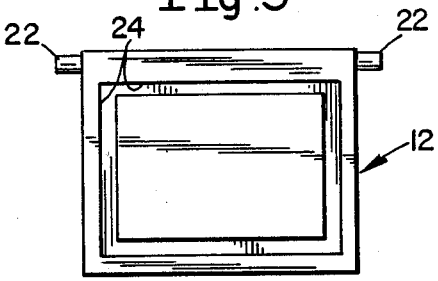
FIG. 3 shows the details of one of the doors of FIGS. 1 and 2.
Figure 4:
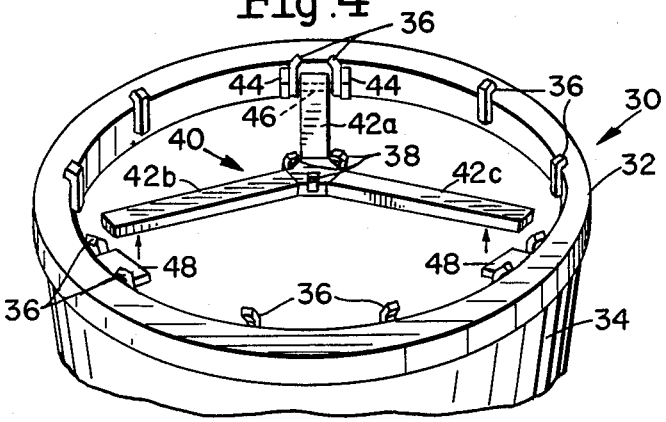
FIG. 4 is a perspective view of the upper end of the container of FIGS. 1 to 2.

The cover 10 has a generally vertical sidewall extending upwardly from rim 20. Three doors 12, 14 and 16 are in this sidewall. Each door has a sign on it such as "GLASS", "FOOD", "ALUMINUM", to indicate the type of waste products that are to be fed into that door. Each door rotates about a shaft 22 (FIG. 3). The shafts are mounted on flanges 23 at 23*a*. Each door has an inclined shelf 18 at its inlet. Each door 12 has a notch 24 that engages shelf 18, when the door is closed, to seal the trash can and preventing escape of odors.

In operation, the container 30 is prepared for use by placing three bags in the three spaces between arms 42*a*, 42*b* and 42*c*. Each bag will be about as high as the container 30. The divider 40 may be rotated about pin 46, or completely removed from the container 30, as the person who installs the bags prefers. The cover 10 is then placed on the container 30 in an angular position so that all material fed in any given door 12, 14, 16 will fall in the desired bag. The trash will, therefore, be presorted for the trash collector. One big advantage of my invention is that all three bags may be removed together and similarly three new bags can be mounted on the divider at any convenient location and then inserted into the container as a unit.

Figure 8:
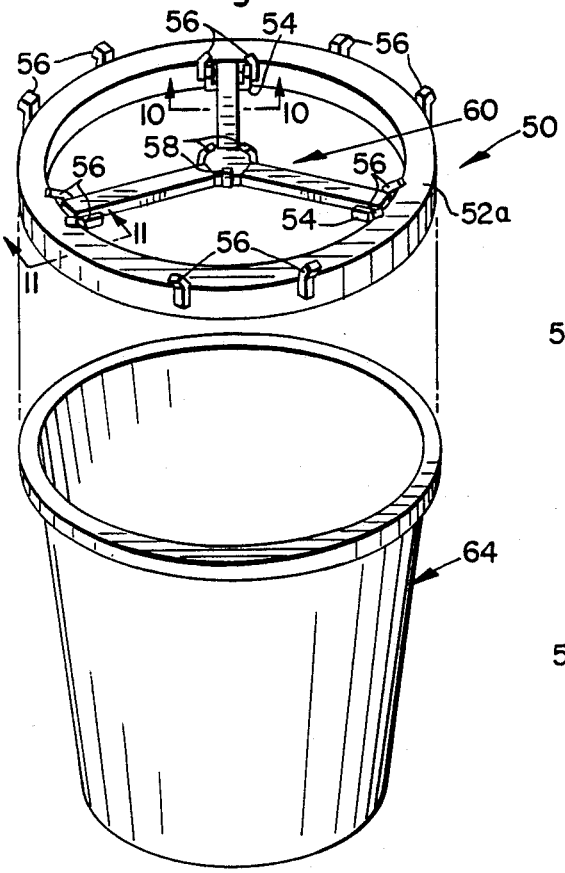
FIG. 8 is a perspective view of a modified form of the invention.
Figure 9:
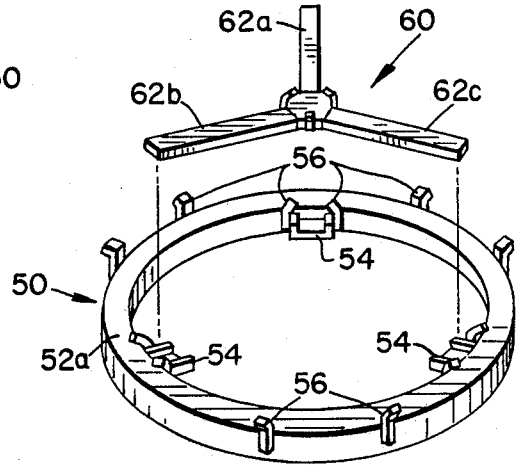
FIG. 9 is a further view of the modified form of FIG. 8 with the divider 60 raised.
Figure 12:
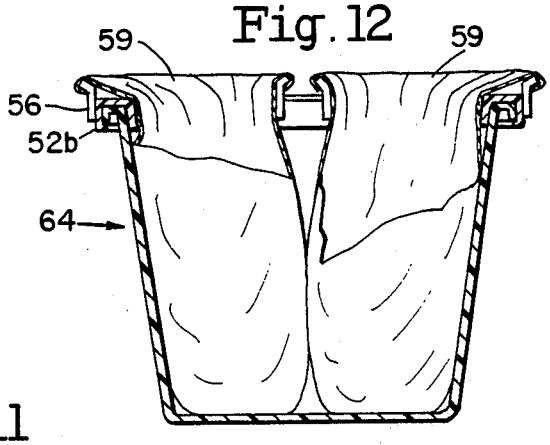
FIG. 12 shows the container of FIG. 8 with bags added.
Figure 10:
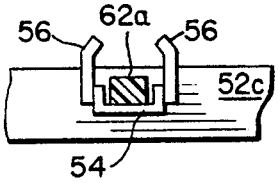
FIG. 10 is a detail view taken along line 10—10 of FIG. 8.
Figure 11:
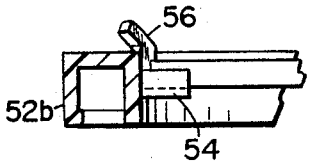
FIG. 11 is a detail view taken along line 11—11 of FIG. 8.
Figure 13:
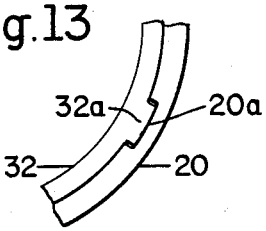
FIG. 13 is a cross-section of the tongue and groove connection between the cover and the container.

FIG. 8 shows a modified form enabling the invention to be added to existing trash cans such as 64. The rim 50 has a part 52*a*, of inverted U-shape (see 52*b*, FIG. 11), molded to fit snugly over the rim of can 64. The rim 50 has three sockets each comprising a U-shaped shelf 54. The divider 60 has three free ends, one for each shelf 54. The rim 50 has projections or hooks 56 and the divider 60 has projections or hooks 58. Three bags are held in place on the projections or hooks 56 and 58, as more fully shown in FIG. 12, and as described in connection with FIGS. 1 to 7. The divider 60 has three arms 62*a*, 62*b* and 62*c*. Arm 62*a* is shown in a U-shaped socket 54 in FIG. 10 and the other two arms would similarly rest in their respective sockets.

The trash can of FIGS. 8 to 11 would have a cover similar to cover 10 of FIGS. 1 and 2. The trash can of FIGS. 8 and 9 could also be used as described in connection with FIG. 1.

While I have illustrated my invention in the form of a trash can for sorting waste products it should be understood that the invention could be used for sorting other products.

I claim to have invented:

1. In a container:

a receptacle having a bottom, side wall means, and an upper end, divider means for dividing said upper end into a plurality of open spaces through which products may enter the receptacle, said divider means and said receptacle comprising supporting means for holding a bag below each of said open spaces so that each bag will receive any product entering the open space above it, said receptacle including socket means for receiving said divider means and for positioning said divider means in said upper end, cover means removably supported on said upper end of said receptacle and defining a plurality of openings, one for each of said open spaces, and said cover means, said receptacle and said divider means being shaped to fit together only in a manner to position each of said openings above its complementary open space, and comprising means for insuring that products entering any opening falls through the open space that is complementary to the opening that received the products.

2. In a container as defined in claim 1:

said supporting means comprising projections, on said divider means and said receptacle extending upwardly, for holding a bag.

3. In a container as defined in claim 1:

said socket means comprising a plurality of sockets having a shelf on which said divider means may rest and also having side walls for preventing said divider means from sliding off of said shelf.

4. In a container as defined in claim 1:

said cover means having a lower end that mates with said receptacle and has side wall means extending upwardly, said plurality of openings being located in said side wall means.

5. In a container as defined in claim 4:

said side wall means including indicating means associated with each opening for indicating the type of product to be placed in such opening.

6. In a container as defined in claim 4:

a door for each said opening, each door having a sign on it to indicate the type of product to be fed into the opening.

7. In a container as defined in claim 6, said sidewall means defining a shelf extending inwardly and downwardly into the container, said door having a lower end that engages said shelf when the door is closed to tend to hold odors in the container.

8. In a container as defined in claim 6:

each said door being above one of said open spaces so that products fed into any given door will only fall into the bag complementary to that door.

9. In a container:

a receptacle having a bottom, side wall means, and an upper end, a rim at said upper end of said receptacle, divider means for dividing said upper end into a plurality of open spaces through which products may enter the receptacle, said divider means and said rim comprising supporting means for holding a bag below each of said open spaces so that each bag will receive any product entering the open space above it, said rim including socket means for receiving said divider means and for positioning said divider means in said upper end, cover means removably supported on said rim and defining a plurality of openings, one for each of said open spaces, so that products fed through a selected one of said openings will enter a particular one of said bags, said socket means comprising a plurality of sockets having a shelf on which said divider means may rest and also having side walls for preventing said divider means from sliding off of said shelf, said socket means having a socket that includes a horizontal pin, said divider means having a forked end that has two fingers forming a fork, one of said fingers being above said pin and one below it, so that said divider means may be rotated about said pin.

10. In a container as defined in claim 9:

said divider means having three arms joined together to divide said upper end into three open spaces, one of said three arms having said forked end, the other two arms each having a free end that rests on the shelf of one of said sockets.

11. In a trash can:

a container having a bottom and generally vertical sidewalls extending upwardly from said bottom, said sidewalls terminating in an open upper end, divider means supported by said sidewalls for dividing said open end into a plurality of open spaces, means associated with each of said open spaces, for holding a bag below the open space so that the bag will have an open end facing upwardly, removable cover means for said container and having an opening above each said open space, positioning means for enabling said removable cover means, when it is placed on said container, to fit onto said container only in a single predetermined position relative to said divider means so that products placed in any given opening will enter the open space that is complementary to that opening, and means associated with each opening for indicating the type of product to be placed in said opening.

12. In a trash can as defined in claim 11:

said positioning means comprising a tongue and groove connection between said container and said removable cover means which permits them to fit together in only one orientation, said divider means and said container including means that permits the divider means to fit said container in only one orientation.

13. In a trash can as defined in claim 11:

said positioning means including means for permitting said container and said removable cover means to fit together in only one orientation, said divider means and said container including means that permits the divider means to fit said container in only one orientation.

14. In a trash can:

a container having a bottom and generally vertical sidewall means extending upwardly from said bottom, said sidewall means terminating in an open upper end, divider means, supported by said sidewall means, for dividing said open end into a plurality of open spaces, a trash collecting device, for each such open space, comprising means for collecting trash that passes through its complementary open space, and positioning means for enabling said divider means, when it is placed on said container, to fit onto said container only in a single predetermined position relative to said container.

15. In a trash can as defined in claim 11:

removable cover means for said container, said removable cover means defining an opening above each said open space, said positioning means including means for permitting said container and said removable cover means to fit together in only one orientation.

16. In a trash can as defined in claim 15:

means associated with each said opening for designating the type of trash to be fed through such opening.

17. In a container for sorting products:

a container having a bottom and sidewall means extending upwardly from said bottom to form an open end of the container, cover means covering said open end, said cover means having a plurality of spaced-apart openings for receiving products to be stored, said container and said cover means defining a substantially hollow interior extending upwardly from said bottom to said openings, divider means extending across said hollow interior for dividing one horizontal plane of said hollow interior into a plurality of open spaces, one for each of said openings, so that each opening has its complementary open space, and positioning means for permitting said divider means to be positioned, when in said horizontal plane, in only a single orientation relative to said openings so that products fed into any of one of said openings will always fall through the open space that is complementary to the opening which the product entered.

18. In a container for sorting products as defined in claim 17:

said positioning means including means to position said divider means in said container and in a predetermined orientation to said sidewall means.

19. In a container for sorting products as defined in claim 17:

said divider means constituting an element separate from said container and said cover means, said positioning means enabling said divider means, when used to divide said hollow interior, to have only a single orientation relative to said container and also relative to said cover means.

* * * * *